United States Patent [19]

Grözinger et al.

[11] 3,955,628

[45] May 11, 1976

[54] HAMMER DRILL

[75] Inventors: Dieter Grözinger, Echterdingen; Heribert Schramm, Stuttgart; Steffen Wünsch, Dettenhausen; Erich Vogel, Bernhausen, all of Germany

[73] Assignee: Robert Bosch G.m.b.H., Stuttgart, Germany

[22] Filed: Apr. 18, 1974

[21] Appl. No.: 462,187

[30] Foreign Application Priority Data

May 9, 1973 Germany ..... 2323268

[52] U.S. Cl. ..... 173/13; 173/48; 173/97

[51] Int. Cl.[2] ..... B25D 11/10; E21C 1/02

[58] Field of Search ..... 173/13, 48, 95, 97

[56] References Cited

UNITED STATES PATENTS

| | | | |
|---|---|---|---|
| 2,191,608 | 2/1940 | Coates | 173/97 |
| 3,256,946 | 6/1966 | Jansen et al. | 173/97 |
| 3,395,765 | 8/1968 | Schnettler | 173/13 |

*Primary Examiner*—Ernest R. Purser
*Attorney, Agent, or Firm*—Michael J. Striker

[57] ABSTRACT

A driven output shaft is mounted in a housing and has freedom of limited axial displacement between a first and a second position. A biasing spring permanently biases the output shaft to the first position. An impact member surrounds the output shaft and has a plurality of angularly spaced first axial projections which interdigitate with angularly spaced second axial projections provided on a disk member axially fixed on and turnably surrounding the output shaft. A retaining arrangement is provided in the housing and is engageable with the disk member to prevent rotation of the same when an axial force is exerted upon the output shaft counter to the action of the biasing spring, causing axial displacement of the output shaft to the second position thereof, and engagement of the disk member with the retaining arrangement.

21 Claims, 5 Drawing Figures

Fig.3
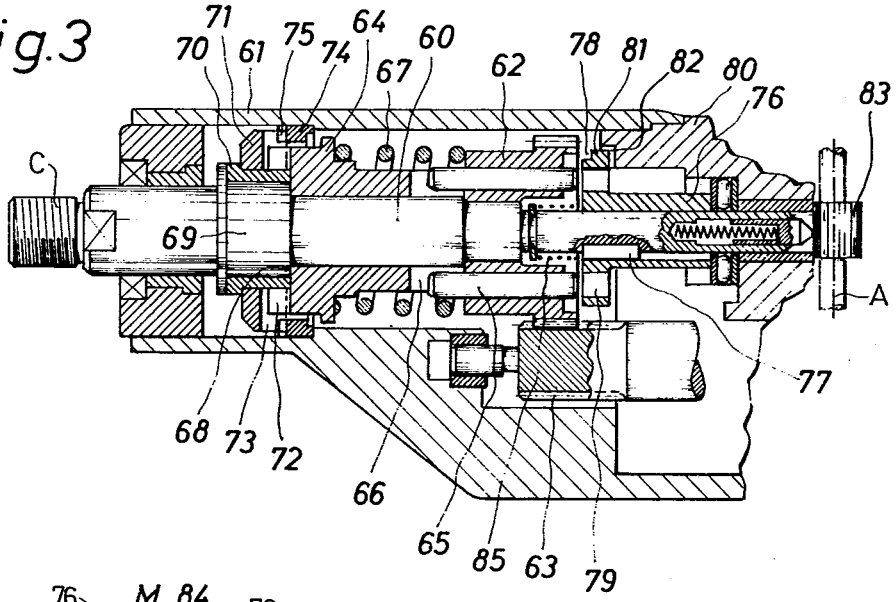
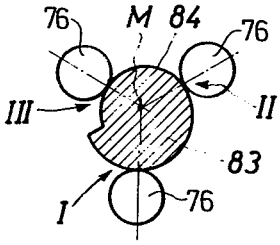
Fig.4
Fig.5
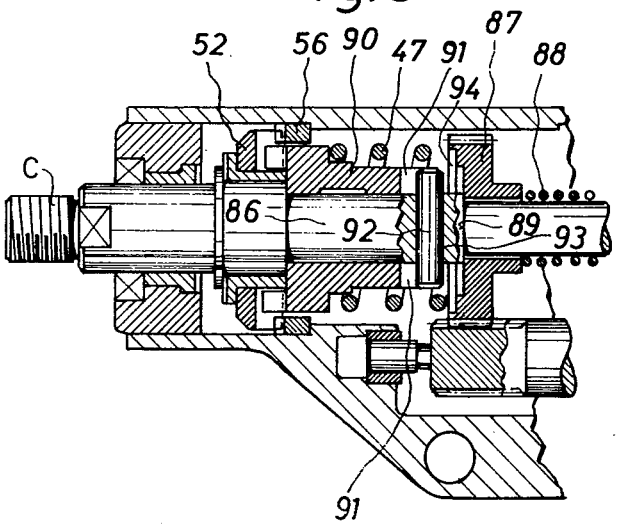

HAMMER DRILL

BACKGROUND OF THE INVENTION

The present invention relates to a hammer drill in general, and more particularly to a hammer drill having an improved construction.

Hammer drills per se are already known. One such prior-art construction has a rotary output shaft on which a disk member is mounted which during drilling use of the hammer drill is connected with projections formed on an impact member, which when the hammer drill is used purely for a drilling operation rotates with the output shaft. When the device is to be used for both drilling and impacting, that is when a hammering motion is superimposed upon the drilling operation, then switching-over from drilling operation results in an abrupt braking of the rotating impact member which now becomes blocked against rotation, whereupon rotating projections on the disk member cooperate with the now stationary projections of the impact member, alternately interdigitating with them and becoming disengaged from them, to impart to the output shaft a reciprocal movement by alternating movement of the impact member towards and away from the disk member.

However, it has been observed that the sudden blocking of the impact member against rotation can lead not only to undesired vibrations of the housing — although during the subsequent actual hammer drill operation, the transmission of such vibrations to the housing and therefore to the user is largely avoided — but can also lead to damage to components of the device, for instance cause damage to the bearings or the like. Evidently, this latter possibility is highly undesirable and although the transmission of vibrations to the housing and thereby to a user will normally occur only during the switching-over from drilling to hammer-drilling operation and not later when the hammer drilling operation is actually in progress, even this relatively brief period during which the transmission of vibrations occur, can be unpleasant for a user. Added to these disadvantages is the further drawback that this prior-art construction is relatively complicated and also comparatively bulky.

SUMMARY OF THE INVENTION

Accordingly, it is a general object of the invention to overcome the disadvantages of the prior art.

More particularly, it is an object of the invention to provide an improved hammer drill which is not possessed of these disadvantages.

An additional object of the invention is to provide such an improved hammer drill which is very simple in its construction and highly reliable and efficient in use.

A concomitant object of the invention is to provide such an improved hammer drill which has better life expectancy than those known from the prior art due to its improved construction.

Still a further object of the invention is to provide such a hammer drill which in addition to its pure drilling function and its hammer-drilling function can also be employed for a pure hammering function, that is an operation in which it will only hammer and will not perform any drilling whatsoever. Thus, the novel hammer drill will be significantly more versatile than the prior-art construction.

In keeping with the above objects, and with others which will become apparent hereafter, one feature of the invention resides in a hammer drill which, briefly stated, comprises a housing and a driven output shaft which is mounted in this housing with freedom of limited axial displacement between a first and a second position. Biasing means permanently biases the output shaft to the first position thereof. An impact member surrounds the output shaft and has a plurality of angularly spaced first axial projections. A disk member is axially fixed on and turnably surrounds the output shaft and has a plurality of angularly spaced second axial projections which interdigitate with the first axial projections. Retaining means is provided in the housing and engageable with the disk member for preventing rotation of the same with the output shaft when an axial force is exerted upon the output shaft counter to said biasing means, resulting in axial displacement of the output shaft to the second position thereof.

The construction according to the present invention has all of the advantages which have been outlined above, as desirable. Moreover, the impact member can now be of particularly simple construction, and can be readily exchanged if and when necessary, for instance when it becomes damaged. Also, the impact member will always turn with the output shaft which results in a quieter and more vibration-free operation.

The retaining means for retaining the disk member against rotation when required, may be of the type which interengages with the disk member, but it may also be of the type which frictionally engages the disk member. The latter possibility is especially advantageous because it assures a smooth and vibration-free transition from pure drilling to hammer-drilling operation of the tool. It is particularly advantageous if the retaining means is located radially outwardly of the disk member, rather than axially adjacent the same because this makes it possible to reduce the length of the tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a view similar to FIG. 2 illustrating an additional embodiment of the invention;

FIG. 4 is a diagrammatic sectional view, illustrating the principle of operation of a component of the embodiment of FIG. 3; and FIG. 5 is a view similar to FIG. 3 illustrating still another embodiment of the invention.

DESCRIPTION OF THE PREFERRED EMBODIMENTS

Figure 1:
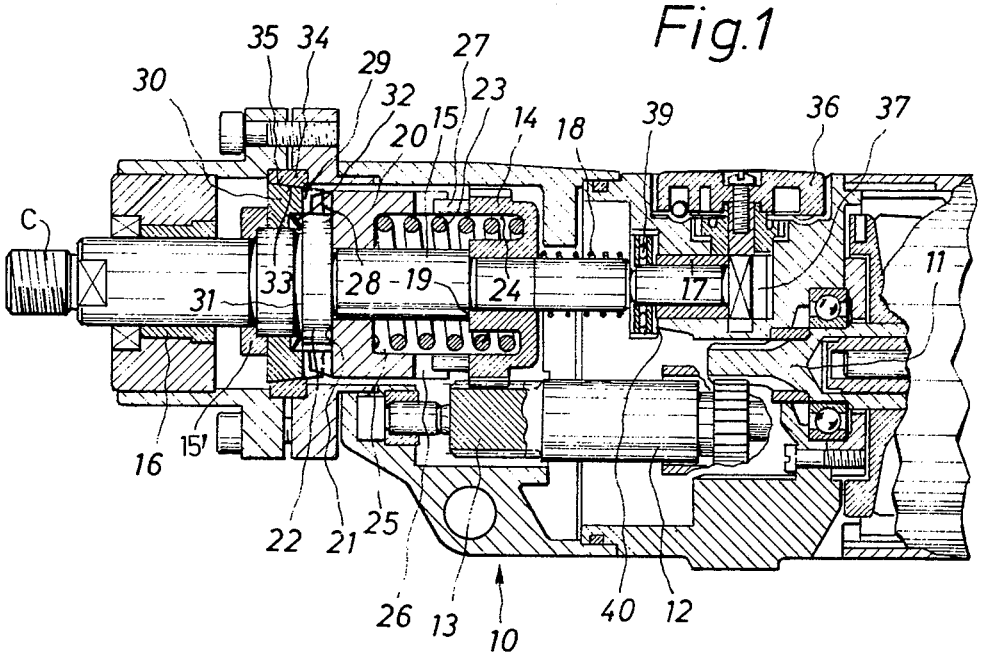
FIG. 1 is a fragmentary longitudinal section through those portion of a hammer drill which are necessary for understanding of one embodiment of the invention.

Referring firstly to the embodiment that is illustrated in FIG. 1, it is pointed out with respect to this and the other Figures that only those portions of a hammer drill have been illustrated which are important for an understanding of the invention. It is evidently conventional for hammer drills to have a motor, usually an electromotor, a switch for activating or de-activating the electromotor, a handle and a gear drive for the output shaft. These components have not been illustrated because they are known per se and are not required for an understanding of the invention.

Returning now to FIG. 1, it will be seen that the hammer drill there illustrated has a housing 10, composed of a plurality of connected components. Arranged in the housing 10, will be the conventional electromotor (not shown), and of course the housing will have conventional handle (not shown). The electromotor drives in the usual manner a stub shaft 11 which is mounted in the housing and which in turn drives an intermediate shaft 12. In FIGS. 1, 2, 3 and 5, the left-hand end of the hammer drill is the working end, that is the end where a connector C (for instance screw threaded as shown) is mounted on the output shaft 15, and to which connector a chuck or the like (not shown) is connected in usual manner to hold the tool, such as a drill bit. At this working end, that is the end facing towards the left in all Figures, the stub shaft 12 of FIG. 1 is provided with gear teeth 13 which are engaged by the teeth of a gear 14 that is mounted fixedly on the output shaft 15 so that it rotates with the latter. The axial length of the teeth 13 is approximately double that of the axial length of the teeth on the gear 14.

A pair of slide bearings 16, 17 is provided which journal the output shaft 15 in the housing 10 for rotation. The output shaft 15 has freedom of limited axial displacement and is urged by a spring 18 in leftward direction; the spring 18 bears against the gear 14 at one of its ends and against an axial needle bearing 39 (which abuts the slide bearing 17) with its other end.

An impact member 20 is mounted on the output shaft 15, surrounding the same and being slidable axially of it. The impact member 20 is urged against a shoulder 21 of collar 22 of the output shaft 15, by the action of a second spring 23 which extends with one end into an axial recess 25 of the impact member where it bears upon the latter and with its other end into an axial recess 24 of the gear 14 where it bears upon the gear. The axial end of the impact member 20 which faces toward the gear 14 is formed with circumferentially spaced axial slots 26, and the gear 14 is provided with axially extending projections 27 (for instance bolts or the like) which extend towards the impact member and which each extend into one of the slots 26, thus assuring that the impact member 20 is entrained in rotation by the gear 14.

The opposite axial end face of the impact member 20, that is the end which faces away from the gear 14, is formed with a plurality of circumferentially spaced projections 24 which interdigitate with similar projections 29 formed on a disk 30. The latter surrounds the output shaft 15 and is turnable with reference to the same. The number of projections 29 is identical with that of the projections 30 and their configuration is identical or substantially so. One or more dished springs 32, — for instance of the Belleville type — is located between the disk 30 and the shoulder 31 which is also formed on the collar 22.

The outer circumferential edge face of the disk 30 is identified with reference numeral 33 and is slightly conical having a cone angle of approximately 6°, the base of the cone facing towards the left in FIG. 1. Radially outwardly of the disk member 30 there is mounted in the disk housing a ring 34 which is fixed against rotation and axial displacement. The opening of the ring 34 is bounded by an inner circumferential surface which also has a cone angle of approximately 6°, and here also the base of the cone faces towards the left in FIG. 1. A retaining ring 15′ which could be replaced by another suitable element, is mounted on the output shaft 15 and fixes the disk member 30 against axial displacement with reference to the output shaft.

A knob 36 or similar member is provided on or in the housing 10 and acts upon a cam 37 which can be turned in engagement with the right-hand axial end of the output shaft 15, so that in one position of the cam 37 the output shaft 15 is shifted towards the left and in the other position (illustrated in FIG. 1) the output shaft 15 is free to be displaced towards the right from its illustrated position by a small amount. The output shaft is, of course, permanently urged towards the left by the spring 18, so that normally the disk member 30 will be pushed leftward out of the confines of the ring 34.

If the device of FIG. 1 is to be used for drilling only, that is if no hammering is to be superimposed upon the drilling operation, then the knob 36 is so turned that the cam 37 engages the output shaft 15 and displaces the same together with the bearing 17 and the bearing 39 towards the left in FIG. 1. Since the gear 14 is mounted fixedly on the output shaft 15, it will travel with the same and the spring 23 will continue to press the impact member 20 against the shoulder 21. The projections 27 of course continue to be engaged in the respective slots 26, so that the impact member 20 will rotate with the gear 14. In this mode of operation, the spring 18 will have shifted the disk member 30 via the shoulder 31 of the collar 22 out of the ring 34, as pointed out before so that the disk member 30 can rotate together with the output shaft 15 since it is not being frictionally braked by engagement with the inner circumferential surface of the ring 34. The projections 28 and 29 are interdigitating engagement with one another and the output shaft 15 performs a purely rotary movement.

If it is desired to obtain both rotary movement and reciprocation of the output shaft 15, so that in addition to rotating the tool (e.g. the drill bit) which is driven by the output shaft 15, the tool will also receive hammer blows upon it, the knob 36 is turned until the cam 37 assumes the position shown in FIG. 1. In this position, the output shaft 15 can be urged towards the right, by an appropriate force acting upon it, that is if the device is urged towards the left so that the tool which is connected with the output shaft 15 is pressed against a workpiece. However, when the cam 37 is turned to this position, the spring 18 continues to urge the output shaft 15 towards the left-hand end position thereof, so that, unless this axially acting force upon the output shaft is in fact applied, the output shaft will continue only to rotate.

If, now, the aforementioned force is applied upon the output shaft 15, and the latter is thereby urged to move towards the right in FIG. 1, which it can do because of the position assumed by the cam 37, the edge face 33 enters into the opening of the ring 34 and becomes frictionally engaged with the inner surface bounding this opening, whereby the disk member 30 is braked and prevented from further rotation. This means that the projections 29 are now also fixed. The disk member 30 of course will remain in this position since it cannot move towards the left, being prevented from this by the presence of the retaining ring 15'. On the other hand, the impact member 20 is coupled via the slots 26 and the projections 27 with the gear 14 and thus with the rotating output shaft 15. This means that as a result of such rotation, the impact member will alternately be pushed towards the right against the action of the spring 23, tensioning the latter, as its projections 28 move out from the recesses between the projections 29 of the disk member 30. When this has taken place the impact member can perform a circumferential rotary movement equal to the distance between two consecutive ones of the projections 29; in other words, as soon as each of the projections 28 on the impact member is again in registry with the next space between two consecutive ones of the projections 29, it will be snapped into this space by the action of the stressed spring 23. This imparts via the impact member 20 upon the output shaft 15 a blow acting in the left-hand direction in FIG. 1, which blow is of course transmitted to the tool. This same process is rythmically continued until the drive of the device is de-activated or until the pressure upon the device in the direction towards the workpiece (towards the left in FIG. 1), is relaxed. The user will barely notice the transmission of vibrations resulting from the blows exerted by the impact member 20, since these vibrations are not transmitted to the housing.

Evidently, as soon as the pressure upon the device in the direction towards the left in FIG. 1 is relaxed, so that the output shaft 15 is no longer being urged towards the right, the last blow exerted by the impact member 20 will shift with the disk member 20 out of the confines of the ring 34, thus permitting it again to rotate with the output shaft 15. This is aided by the biasing force of the spring 18, so that now the projections 28 and 29 become disengaged, that is they no longer interdigitate with one another. This terminates the development of any blows acting upon the output shaft 15 and such blows will not be resumed until and unless the device is again pressed against a workpiece and the shaft 15 shifted towards the right. During the hammer-drilling operation, the necessary axial oscillation of the output shaft 15 which transmits the blows to the tool carried by the chuck or the like mounted on the connector C, is made possible by the provision of the spring or springs 32 without causing a disengagement of the disk member 30 from the ring 34.

Figure 2:
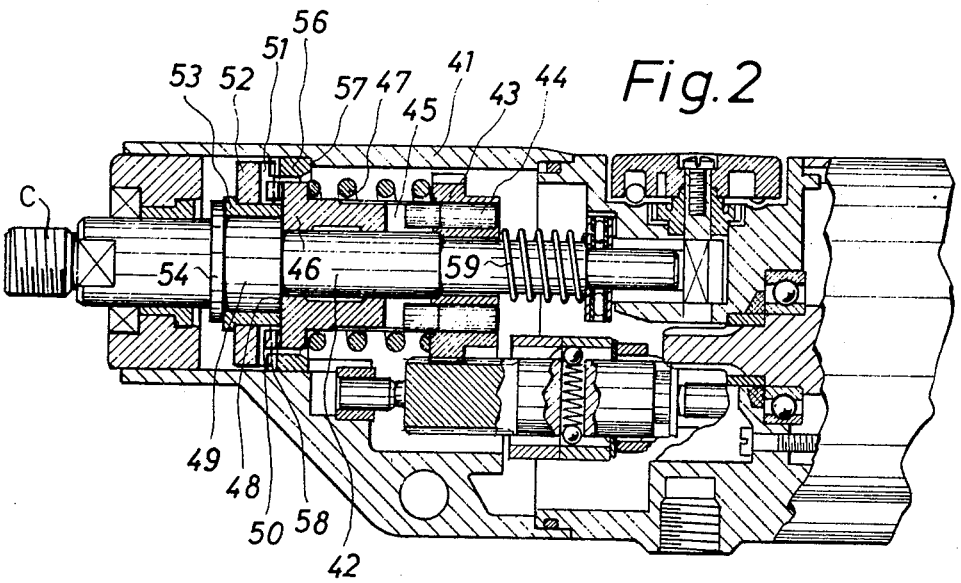
FIG. 2 is a view similar to FIG. 1 but illustrating a further embodiment of the invention.

Coming to the embodiment in FIG. 2 it will be seen that this is largely the same as that of FIG. 1, for which reasons, certain components identical with those of FIG. 1 (for instance the knob 36 and the cam 37) have not been designated with reference numerals.

In FIG. 2 the housing is identified with reference numeral 41 and accommodates the output shaft 42 corresponding to the output shaft 15 of FIG. 1. A gear 43 is fixedly mounted on the output shaft 42 for rotation with the same, and is provided with projections or bolts 44 which extend axially into slots 45 of an impact member 46. The latter is urged by a spring 47 which also bears upon the gear 43, against a shoulder 48 formed on a collar 9 of the output shaft 42. Projections 50 are formed on the impact member 46 and extend towards the left. They interdigitate with projections 51 of a disk member 52 which is journalled on a sleeve 53 provided on a collar 49 of the output shaft 42. The sleeve abuts against a shoulder 54.

In this embodiment, a ring 56 is mounted fixedly in the housing 41, radially outwardly of the impact member 46 and in abutting engagement with a shoulder 57 of the housing. Unlike the ring 34 of FIG. 1, however, the ring 56 is provided with projections 58 facing towards the disk member 52 and being angularly distributed. The purpose of the ring 56 is the same as that of the ring 34, but its function is carried out in a different manner. The number of projections 58 corresponds to the number of projections 50, and the shapes of the projections 50 and 58 are identical or substantially so.

When the device of FIG. 2 is in the hammer-drilling mode and the shaft 46 is displaced towards the right, then the projections 51 of the disk member 52 interdigitate with the projections 58 of the ring 56, thus preventing rotation of the disk member 52. This means that as in the case of the embodiment of FIG. 1, the projections 50 and 51 alternately become engaged and disengaged from one another thereby imparting the desired blows upon the shaft 42, in that each time the impact member 46 is displaced against the force of the spring 47 towards the right, it will subsequently be snapped back towards the left to impact against the shoulder 48 of the collar 49. Also as before, as soon as the force urging the shaft 42 towards the right is relaxed, the spring 59 displaces the shaft 42 towards the left, whereupon the projections 51 of the disk member 52 disengaged from the projections 58 of the rings 56 and the disk member 52 can resume its rotation with the output shaft 42, so that no further impacts will develop.

An additional embodiment of the invention is shown in FIGS. 3 and 4. It again essentially corresponds to the one shown in FIG. 2, but this embodiment provides a further mode of operation in addition to the pure drilling mode and the hammer-drilling mode, namely a pure hammering mode in which the output shaft will not rotate at all.

In FIG. 3 the output shaft is designated with reference numeral 60 and is again journalled in a housing which is designated with reference numeral 61. A gear 62 is mounted on the output shaft 60 and meshes with a pinion 63. Also mounted on the output shaft 60 is an impact member 64.

Unlike the preceding embodiments, the gear 62 in the embodiment of FIGS. 3 and 4 is turnably mounted on the output shaft 60, that is it can turn with reference to the same. The gear 62 has projections 65 which engage in slots 66 of the impact member 64, so that the two are coupled for joint rotation. A spring 67 is located between and bears upon the gear 62 and the impact member 64, respectively. The latter abuts a shoulder 68 of a collar 69 on the output shaft 60, on which collar 69 there is provided a sleeve 70 on which a disk member 71 is mounted. Projections 72 are provided on the impact member 64 and the corresponding projections 73 on the disk member 71. A ring 74 is fixedly (both as to rotation and axial displacement) mounted in the housing 61, radially outwardly of the impact member 64; it has projections 75.

To the right of the gear 62 there is mounted on the output shaft 60 a coupling member 76 which can shift axially of the output shaft 60 but is prevented from rotation relative to the latter by the provision of a key 77. The member 76 has a flange 78 which is formed with bores 79 into which free ends of the projections 65 can enter. Thus, the left-hand end of the projections 65 cooperate with the slots 66 of the impact member, whereas the right-hand ends thereof can enter into the bores 79. A nose 71 is provided at one point of the flange 78 and, when the member 76 is axially shifted, the nose can enter into a cutout 82 of the housing portion 80 in which case the member 76 will be prevented against rotation and, since it is firmly connected with the output shaft 60, the latter will similarly be prevented from rotation.

The embodiment of FIGS. 3 and 4 again has a cam corresponding to the cam 37 of FIGS. 1 and 2, but here identified with reference numeral 83. This cam is turnable about the axis A as are the cams in the preceding embodiments, for which purpose a knob corresponding to the knob 36 of FIG. 1 may be provided (not shown). FIG. 4 shows a cross-section of the cam 83 in somewhat diagrammatic form and it will be seen that the cam 83 has a circumferential cam face which is configurated as an approximately spiral curve 84. At the location I where the surface 84 has its greatest distance from the center M of the cam 83, the output shaft 60 will have been displaced all the way towards the left, so that the device is in the drilling mode. We have shown by way of the circles in FIG. 4, the engagement between the output shaft and the cam 83 in the different positions. The position II is circumferentially spaced with reference to the position I through approximately 120°, which means that when the cam 83 is turned through this angular distance, a point of thee curve 84 will come into contact with the output shaft 60 which is spaced at a lesser distance from the center M, so that correspondingly the output shaft 60 will be displaced to a lesser extent. In this position, the device will be in the hammer-drilling mode and the disk member 71 will be coupled with ring 74.

When the cam 83 is turned further through approximately 120°, so that the point III of its curve 84 is in contact with the output shaft 60 which point has the smallest distance from the center M, the member 76 will have been displaced by the action of a spring 84 towards the right in FIG. 3 to such an extent that the nose 81 extends into the cutout 82 in the manner in which this is illustrated in FIG. 3. Since in this position, the output shaft 60 is blocked against rotation, and since the disk member 71 interengages with the ring 75, the impact member 64 will perform impact movements in the manner described earlier with respect to FIGS. 1 and 2, whereby impacts are transmitted to the output shaft 60 which now performs its reciprocatory movement or oscillatory movement as before. Since the member 60 does not rotate, however, this mode of operation is a pure hammering mode, in which hammer blows are transmitted via the output shaft 60 to the non-illustrated tool. In this position also, the right-hand ends of the projections 65 are withdrawn from the bores 79, but in the modes corresponding to the positions I and II they will be received in these bores 79.

The embodiment of FIG. 5, finally is reminiscent of that in FIG. 2, but presents certain simplifications. Like components are identified with the same reference numerals as in FIG. 2. In FIG. 5, the output shaft 86 has mounted on it a gear 87 which can rotate with but not with reference to the output shaft 86 and which abuts a shoulder 89 of the output shaft.

By contrast to the preceding embodiments, the embodiment of FIG. 5 provides an impact member 90 which is not coupled with the gear 87 by means of coupling portions. Instead, the impact member 90 has two diametrally opposite axially extending slots 91 and a transverse pin 92 is fixedly mounted in a transverse bore 93 of the output shaft 86 and its end portions which extend beyond the periphery of the output shaft 86 are received in the respective slots 91. Thus, the impact member 90 is directly connected with the output shaft 86 for rotation with the same rather than indirectly as in the preceding embodiments. The axial length of the slots 91 is greater than the diameter of the pin 92, so that the impact member 90 can become displaced rightwards from the position of FIG. 5 and to permit this the gear 87 is provided with recesses 94.

The other components and the operation of the device in FIG. 5 will be understood to be the same as in the embodiment of FIG. 2.

It will be understood that each of the elements described above, or two or more together, may also find a useful application in other types of constructions differing from the types described above.

While the invention has been illustrated and described as embodied in a hammer drill, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features, that from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A hammer drill comprising a housing; a driven output shaft mounted in said housing with freedom of limited axial displacement between a first and a second position; biasing means permanently biasing said output shaft to said first position; an impact member surrounding said output shaft and having a plurality of angularly spaced first axial projections, said impact member being axially shiftable on and rotatably driven with said output shaft; a disk member axially fixed on and freely turnably surrounding said output shaft and having plurality of spaced second axial projections adapted to interdigitate with said first axial projections; retaining means fixed in said housing and engageable with said disk member for preventing rotation of the same with said output shaft when an axial force is exerted upon said output shaft counter to said biasing means and axially displacing said output shaft to said second position thereof; and spring means acting on said impact member for causing the latter to impart hammer blows on said output shaft when said disk member is prevented from rotation with said output shaft while the latter continues to rotate.

2. A hammer drill as defined in claim 1; and further comprising control means having a first and a second operative mode in which it respectively permits and prevents axial displacement of said output shaft from said first to said second position thereof.

3. A hammer drill as defined in claim 1, wherein the number of said first axial projections equals the number of said second axial projections and all of said axial projections are of identical shape.

4. A hammer drill as defined in claim 1, wherein said retaining means is located radially outwardly of at least one of said members and engageable with said second axial projections of said disk member.

5. A hammer drill as defined in claim 1, wherein said retaining means is a ring fixedly mounted in said housing and having third axial projections facing toward said second axial projections and engageable with the same when said output shaft is displaced to said second position thereof.

6. A hammer drill as defined in claim 1, said disk member having an outer circumferential edge face of conical contour; and wherein said retaining means comprises a ring fixedly mounted in said housing and having an opening adapted to fittingly accommodate said disk member and bounded by an inner circumferential surface configurated matingly with reference to said edge face so that, when said disk member enters said opening in response to displacement of said output shaft to said second position, said edge face and inner circumferential surface will frictionally engage one another and cooperate to prevent rotation of said disk member.

7. A hammer drill as defined in claim 1, wherein said impact member is permanently connected for rotation with said output shaft.

8. A hammer drill as defined in claim 7, wherein said impact member is directly connected with said output shaft for rotation with the same.

9. A hammer drill as defined in claim 1, wherein said impact member is indirectly connected with said output shaft for rotation with the same.

10. A hammer drill as defined in claim 7, said impact member being formed with a pair of diametrically opposite slots; and further comprising a pin fixedly connected with said output shaft and extending into said slots.

11. A hammer drill as defined in claim 7; further comprising a gear mounted on said output shaft for rotation with the same; and cooperating coupling portions on said gear and on said impact member for connecting the latter with said gear and thereby with said output shaft for rotation with the latter.

12. A hammer drill as defined in claim 1, said output shaft having a shoulder; further comprising a gear mounted on said output shaft for rotation with the same axially spaced from said shoulder; said spring means bearing against said gear and urging said impact member against said shoulder.

13. A hammer drill as defined in claim 1; wherein said biasing means comprises a spring bearing on said output shaft.

14. A hammer drill as defined in claim 13; further comprising a gear fixedly mounted on said output shaft for rotation therewith, and an axial bearing on said output shaft spaced from said gear; and wherein said spring bears on said gear and said bearing, respectively.

15. A hammer drill, as defined in claim 1, said output shaft having a shoulder adjacent said disk member; and further comprising at least one dished spring intermediate and bearing upon said shoulder and disk member, respectively.

16. A hammer drill as defined in claim 11, wherein said coupling portions comprise recesses provided on said impact member, and pins provided on said gear and extending into the respective recesses.

17. A hammer drill as defined in claim 1; and further comprising selectively operable means for preventing rotation of said output shaft and constrain the latter to said axial displacement between said first and second positions.

18. A hammer drill comprising a housing; a driven output shaft mounted in said housing with freedom of limited axial displacement between a first and a second position; biasing means permanently biasing said output shaft to said first position; an impact member surrounding said output shaft and having a plurality of angularly spaced first axial projections, said impact member being rotatably driven with said output shaft; a disk member axially fixed on and freely turnably surrounding said output shaft and having a plurality of spaced second axial projections adapted to interdigitate with said first axial projections; retaining means in said housing and engageable with said disk member for preventing rotation of the same with said output shaft when an axial force is exerted upon said output shaft counter to said biasing means, resulting in axial displacement of said output shaft to said second position thereof; and selectively operable means for preventing rotation of said output shaft and constraining the latter to said axial displacement between said first and second positions, said selectively operable means comprising an abutment on said housing, and a sleeve non-rotatably mounted on said output shaft for axial shifting on the latter into and out of engagement with said abutment.

19. A hammer drill as defined in claim 18; and further comprising control means having a first operative mode permitting axial displacement of said output shaft from said first to said second position thereof, a second operative mode preventing such displacement, and a third operative mode permitting such displacement and effecting shifting of said sleeve into engagement with said abutment.

20. A hammer drill as defined in claim 19, wherein said control means comprises a cam having three cam positions corresponding to the respective operative modes, and a knob associated with said cam for displacing the same between said cam positions.

21. A hammer drill as defined in claim 20, said cam having a cam face which acts upon said output shaft and has a contour substantially resembling a spiral curve.

* * * * *